US010160106B2

(12) United States Patent
Subramaniam et al.

(10) Patent No.: US 10,160,106 B2
(45) Date of Patent: Dec. 25, 2018

(54) PROGRAMMABLE TOOL ORIENTATION BASED, ASSEMBLY TIGHTENING CONTROL

(71) Applicant: Toyota Motor Engineering & Manufacturing North America, Inc., Erlanger, KY (US)

(72) Inventors: Ajanthan Subramaniam, Markham (CA); James Clifford Rose, Guelph (CA); Jordan James Moreau, Kitchener (CA)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 179 days.

(21) Appl. No.: 15/136,940

(22) Filed: Apr. 24, 2016

(65) Prior Publication Data

US 2017/0305002 A1 Oct. 26, 2017

(51) Int. Cl.
*B25B 23/145* (2006.01)
*B25B 21/00* (2006.01)
*B25B 23/147* (2006.01)

(52) U.S. Cl.
CPC ..... *B25B 23/1456* (2013.01); *B25B 21/00* (2013.01); *B25B 23/147* (2013.01)

(58) Field of Classification Search
CPC .... B25B 23/1456; B25B 23/147; B25B 21/00
USPC ..... 81/469
See application file for complete search history.

(56) References Cited

U.S. PATENT DOCUMENTS

| | | | | |
|---|---|---|---|---|
| 7,096,569 | B1 * | 8/2006 | Barr | B25B 23/14 29/700 |
| 7,841,100 | B2 | 11/2010 | Lucke | |
| 9,475,180 | B2 * | 10/2016 | Eshleman | B25B 21/004 |
| 9,533,403 | B2 * | 1/2017 | Lee | B25B 21/00 |
| 9,700,970 | B2 * | 7/2017 | Lee | B23P 19/04 |
| 2008/0319570 | A1 * | 12/2008 | Van Schoiack | B23P 19/06 700/110 |
| 2011/0214890 | A1 | 9/2011 | Wallgren | |
| 2013/0175065 | A1 | 7/2013 | Terada et al. | |
| 2013/0345849 | A1 * | 12/2013 | Drasovean | B25B 21/00 700/117 |
| 2014/0190314 | A1 | 7/2014 | Ono et al. | |
| 2014/0216772 | A1 | 8/2014 | Lee | |

FOREIGN PATENT DOCUMENTS

WO 2009105008 A1 8/2009

* cited by examiner

*Primary Examiner* — Hadi Shakeri
(74) *Attorney, Agent, or Firm* — Christopher G. Darrow; Darrow Mustafa PC

(57) ABSTRACT

In an embodiment herein, a tool is described. The tool comprises an inclinometer configured to determine a first inclination of the tool; and transmit a first indicator to a controller in response to determining the first inclination of the tool. The tool further comprises a controller interface configured to receive a first program from the controller in response to transmitting the first indicator. The tool further comprises a tool head configured to tighten a first fastener based, at least in part, on the first program.

14 Claims, 4 Drawing Sheets

PROGRAMMABLE TOOL ORIENTATION BASED, ASSEMBLY TIGHTENING CONTROL

TECHNICAL FIELD

The subject matter described herein relates in general to fastening devices, and more particularly, to programmable fastening tools.

BACKGROUND

Some manufacturing requires repeated tightening of fasteners. Fastening tools, e.g., a nutrunner, are programmed for repeated tightening of a particular type of fastener. The programmable tools execute a single program for a single type of fastener. If a user desires to use the tool to tighten more than one type of fastener, additional programs can be added to a controller to be selected by the user, or other input device, for each fastener. In this case, an optimal program exists for each fastener, but introduces a possible fault into the production process if the user or input device selects the wrong program for a fastener. In some cases, a compromise program is developed, using characteristics of two different tightening programs in a single program. This results in a program that may be used for two different fasteners, but is not optimal for either fastener. If a compromise program is not possible, the user must switch between two tools, or two programs, to tighten the two different fasteners. Switching tools adds burden to the production process and introduces a possible fault into the production process if the user uses the wrong tool or program for a fastener.

SUMMARY

In an embodiment herein, a tool is described. The tool comprises an inclinometer configured to determine a first inclination of the tool; and transmit a first indicator to a controller in response to determining the first inclination of the tool. The tool further comprises a controller interface configured to receive a first program from the controller in response to transmitting the first indicator; and a tool head configured to tighten a first fastener based, at least in part, on the first program.

In another embodiment herein, a method for inclination based program selection is described. The method comprises determining, by an inclinometer, a first inclination of a tool; transmitting, by the inclinometer, a first indicator to a controller in response to determining the first inclination of the tool; receiving, by the tool, a first program from the controller in response to transmitting the first indicator; and tightening, by the tool, a first fastener based, at least in part, on the first program.

In another embodiment herein a system for inclination based program selection is described. The system comprises a tool comprising: an inclinometer configured to determine a first inclination of the tool; and transmit a first indicator to a controller in response to determining the first inclination of the tool. The tool further comprises a controller interface configured to receive a first program from the controller in response to transmitting the first indicator; and a tool head configured to tighten a first fastener based, at least in part, on the first program. The system further comprises the controller configured to receive the first indicator; determine the first program based, at least in part on the first indicator; and transmit the first program to the tool.

DETAILED DESCRIPTION

Embodiments described herein provide inclination based nutrunner program selection. A nutrunner may include an inclinometer for measuring an inclination of the nutrunner. The nutrunner may be positioned on a fastener. The inclinometer may detect the inclination of the nutrunner and send a signal to a controller. The controller may select a tightening program based upon the inclination of the inclinometer. The controller may then control the nutrunner to tighten the fastener using the selected program. While the embodiments described herein relate to a nutrunner, any tool that is used at multiple inclinations may be configured similarly to the embodiments described herein.

Figure 1:
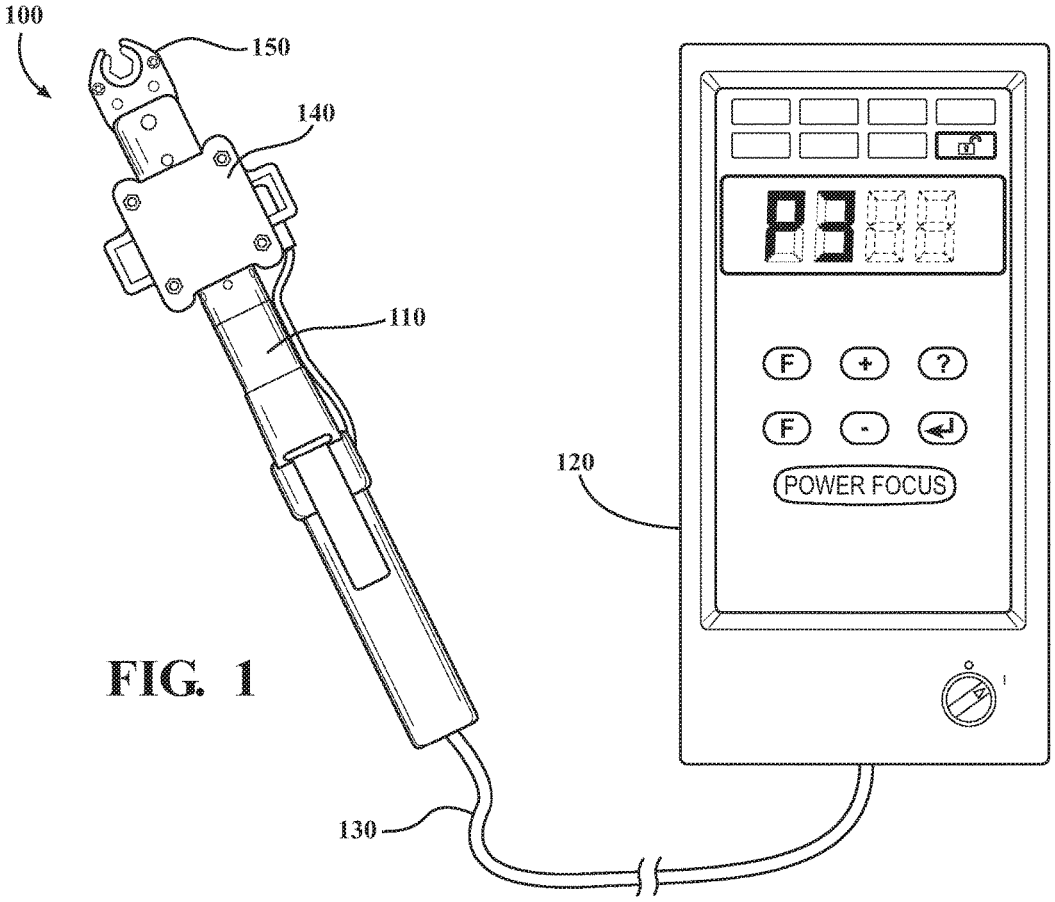
FIG. 1 is a diagram of an embodiment of a system for inclination based nutrunnner program selection.

FIG. 1 is a diagram of a system 100 for inclination based tightening program selection. The system 100 may comprise a nutrunner 110 and a controller 120. The nutrunner 110 may be a pneumatic, electric, or hydraulic driven tool for tightening a nut. In some embodiments, the nutrunner may be replaced with some other programmable tool that is operated at varying inclinations. Nutrunner 110 may be a cylindrical nutrunner, or a pistol grip type nutrunner or any other configuration of nutrunner. In some embodiments, the nutrunner 110 may be used on an automotive assembly line or in some other tightening or assembly application.

Controller 120 may be selected to be compatible with nutrunner 110. Controller 120 may be selected to provide a consistent torque to each fastener tightened by nutrunner 110. Based on the nutrunner 110, the controller 120 may be an electrical controller, a pneumatic controller, or a hydraulic controller. Controller 120 may include manual controls such as potentiometers, dials, and switches. Displays on controller 120 may be needle-based meters, light emitting diode (LED) indicators, or some other indicator device. In some embodiments, users may setup or program controller 120 with a digital keypad or menu on a graphical user interface and an internal central processing unit (CPU) or programmable logic controller (PLC). In some embodiments, controller 120 may interface with a computing device via a serial or parallel interface along with application software for control and monitoring. Serial interfaces may include RS232, RS485 and universal serial bus (USB). Parallel interfaces may include the general-purpose interface bus (GPIB), Hewlett Packard Interface Bus (HPIB). GPIB may also be referred to as the IEEE 488 bus, which may be electrically equivalent to the IEC 625 bus. Controller 120 may be configured to drive multiple nutrunners. Controller 120 may be further configured to include soft starting, automatic shutoff, and remote control. Soft starting may increase torque gradually in order to minimize cross-threading. Automatic shutoff may be activated when a torque or angle limit is achieved. The nutrunner 110 and controller 120 may communicate via a cable 130. Cable 130 may connect to an interface on the controller and an interface on the nutrunner. In other embodiments, the nutrunner may communicate wirelessly with controller 100. In still other embodiments, the nutrunner 110 may contain the controller 120.

Nutrunner 110 may comprise an inclinometer 140 and a tool head 150. Inclinometer 140 may be configured to determine the inclination of the nutrunner 110 relative to gravity or some other reference point. The inclinometer 140 may be implemented using any technology for measuring inclination. In some embodiments, the inclinometer 140 may use an accelerometer, liquid capacitive, electrolytic, gas bubble in liquid, or pendulum for sensing inclination. Inclinometer 140 may use microelectromechanical systems (MEMS) for sensing inclination. Inclinometer 140 may be a 2-axis inclinometer. Inclinometer 140 may be configured to determine inclination along either or both the axis of the tool or the axis of the fastener. The mounting position (e.g., along the axis of or horizontally opposed to the nutrunner 110) of inclinometer 140 on nutrunner 110 may determine whether inclination is determined along the axis of the tool or the axis of the fastener.

Tool head 150 may be a socket or crowfoot or any other fixture for tightening a fastener. Tool head 150 may accept sockets of varying sizes and types. In-line heads may rotate concentrically with the drive of nutrunner 110. Offset heads may rotate parallel to but offset from the drive axis nutrunner 110. Right-angle heads may rotate 90° to the drive axis of nutrunner 110. Crowfoot heads may be flat, extended and/or angled heads for difficult-to-access locations. Tubenut heads may have openings for slipping over a nut before and after tightening.

Controller 120 may store a number of tightening programs. Depending on the fastener being tightened by nutrunner 110, one of the tightening programs may be selected. The tightening program may be selected based upon the inclination of the inclinometer 140. The tightening programs may store information related to tightening the fastener, for example torque, angle of rotation, speed of rundown, and other information that may be used for identifying and/or tightening a fastener.

Figure 2:
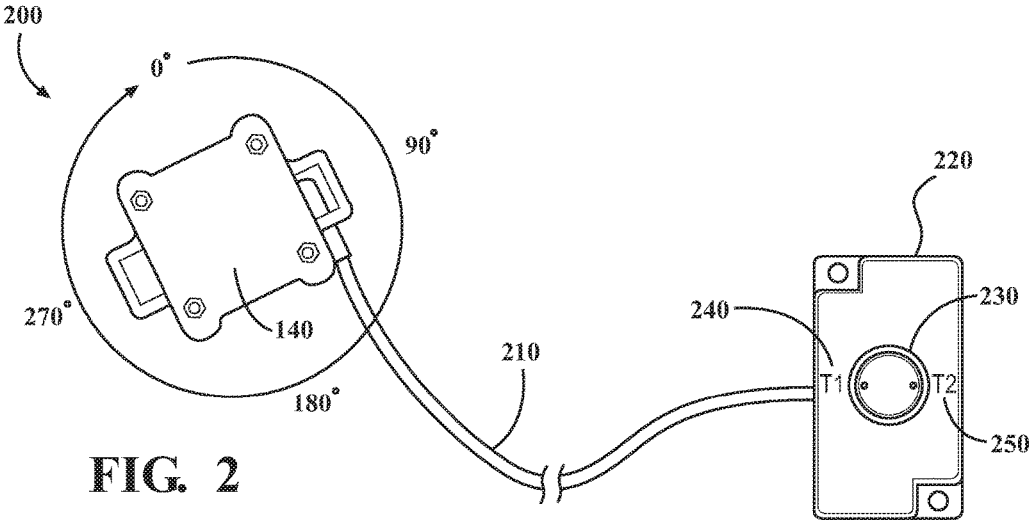
FIG. 2 is a diagram of an embodiment of a system for programming an inclinometer for inclination based nutrunnner program selection.

Turning now to FIG. 2, a system 200 for programming inclinometer 140 is provided. Inclinometer 140 may be programed to output indicators of the inclination of the inclinometer 140 relative to gravity or some other reference point. Inclinometer 140 may be coupled to training device 220 via cable 210. Cable 210 may connect to inclinometer 140 via an interface on the inclinometer 140. In some embodiments, inclinometer 140 may be coupled to training device 220 wirelessly. In still other embodiments, the inclinometer 140 may contain the training device 220. Training device 220 may comprise a switch 230. Switch 230 may be a multi-position toggle switch comprising position T1 240 and position T2 250. The number of positions of switch 230 may be based upon a number of outputs of the inclinometer. In this embodiment, inclinometer 140 may have two programmable outputs, and switch 230 may have two corresponding positions. In other embodiments, inclinometer 140 may have any number of programmable outputs. Inclinometer 140 may be positioned at a first inclination, e.g. on a first fastener, and the switch 230 may be toggled to position T1 240. When the switch 230 is toggled to position T1 240, the inclinometer 140 may be programmed to output a signal that indicates the inclinometer 140 is at the first inclination. Inclinometer 140 may be positioned at a second inclination, e.g. on a second fastener, and the switch 230 may be toggled to position T2 250. When the switch 230 is toggled to position T2 250, the inclinometer 140 may be programmed to output a signal that indicates the inclinometer 140 is at the second inclination. When the switch 230 is toggled to a programming position, a range of inclinations may be stored that cause the switch to output the indicator. For example, the inclinometer may be positioned at 40 degrees of inclination and switch 230 may be togged to position T1 240. Inclinometer may store the range of 20 to 60 degrees and output an indicator when the inclinometer is anywhere between 20 and 60 degrees. Other ranges of inclination may be used depending upon the tightening application, accuracy of the inclinometer, or other factors.

In other embodiments, switch 230 may have more than two positions, or may not be a toggle switch, but some other input device for training inclinometer 140 to output an indicator of a particular inclination. In some other embodiments, the inclinometer may not be programmed and may output a measured inclination (e.g., a measure of the inclination relative to gravity) that may be used by the controller 120 to determine which program to select.

Figure 3A:
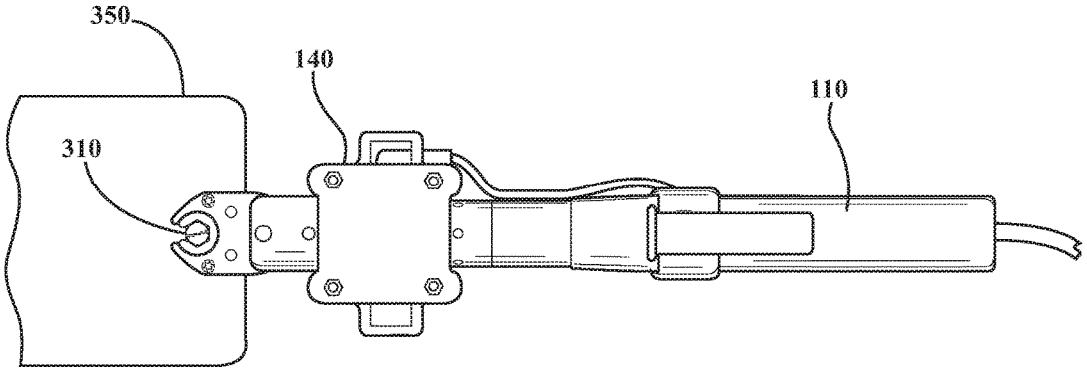
FIG. 3A is a diagram of a nutrunner at a first inclination.
Figure 3B:
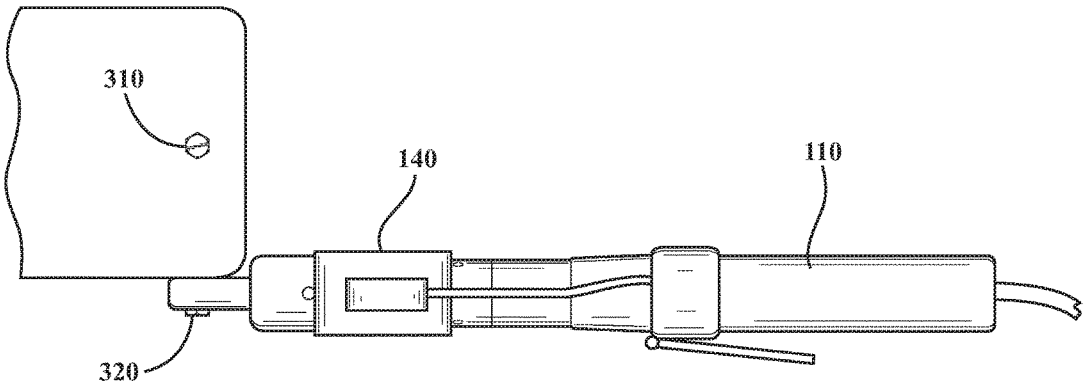
FIG. 3B is a diagram of a nutrunner at a second inclination.

The functionality of the nutrunner 110 after programming is described with respect to FIG. 3A and FIG. 3B. FIG. 3A is a diagram of a nutrunner 110 positioned at a first inclination to tighten fastener 310 on object 350. When inclinometer 140 detects that it is oriented at the first inclination, a signal may sent from the inclinometer 140 to the controller 120 indicating the inclinometer 140 is at the first inclination. Controller 120 may then cause the nutrunner 110 to tighten fastener 310 in accordance with a program retrieved based on the indication received from the inclinometer 140 indicating that the inclinometer is in the first inclination.

FIG. 3B is a diagram of a nutrunner 110 positioned at a second inclination to tighten fastener 320 on object 350. When inclinometer 140 detects that it is positioned at the second inclination, a signal may sent from the inclinometer 140 to the controller 120 indicating the inclinometer is at the second inclination. Controller 120 may then cause the nutrunner 110 to tighten fastener 320 in accordance with a program retrieved based on the indication received from the inclinometer 140 indicating that the inclinometer is in the second inclination.

Figure 4:
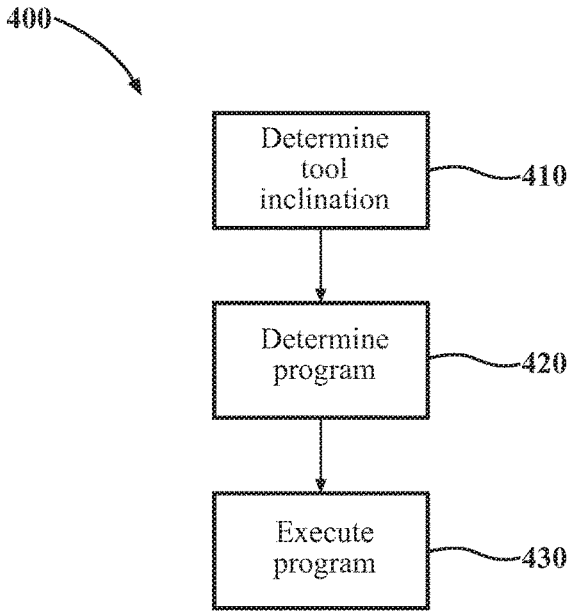
FIG. 4 is flow diagram of an embodiment of a method for inclination based nutrunnner program selection.

FIG. 4 is a flow diagram of an embodiment of a method 400 for selecting a tightening program based upon inclination of a nutrunner. The method 400 begins at step 410 where an inclination of the nutrunner, e.g. nutrunner 110, is determined. Inclination may be determined by an inclinometer, e.g. 140, coupled to or integrated with the nutrunner. In some embodiments, the nutrunner may be programmed to only function at two inclinations. In this case, the inclinometer may provide an indicator that the nutrunner is at one of the acceptable inclinations. The indication from the inclinometer may be a signal that the inclinometer is at the inclination, e.g. a terminal going from a low value to a high value or vice versa. In other embodiments, the inclinometer may provide a measured inclination, e.g. a transmission indicating the inclination. In some embodiments, the inclinometer may be configured to provide the indication when the nutrunner is in a range of inclinations. For example, the inclinometer may be programmed to provide a first indication when the tool is between 0 and 40 degrees. Other inclinations may be selected with a plus or minus of twenty degrees of inclination or some other value (e.g. 10 degrees or 50 degrees) for the tolerance of the inclination.

At step 420, the controller, e.g. controller 120, may determine a program based upon the indicator of inclination received from the inclinometer. In some embodiments, the inclinometer may be programmed to send one or more indicators based upon the inclination of the inclinometer. In other embodiments, the inclinometer may transmit the actual inclination of the inclinometer. The indicator received from the inclinometer may be associated with a tightening program. The controller may store any number of tightening programs and each may be associated with one or more inclinations. In some embodiments, the tightening of fasteners may happen in a particular sequence, and the controller may not allow the tightening of a second fastener until a first fastener has been tightened. After the program associated with the inclination is retrieved, the program may be executed at step 430.

Figure 5:
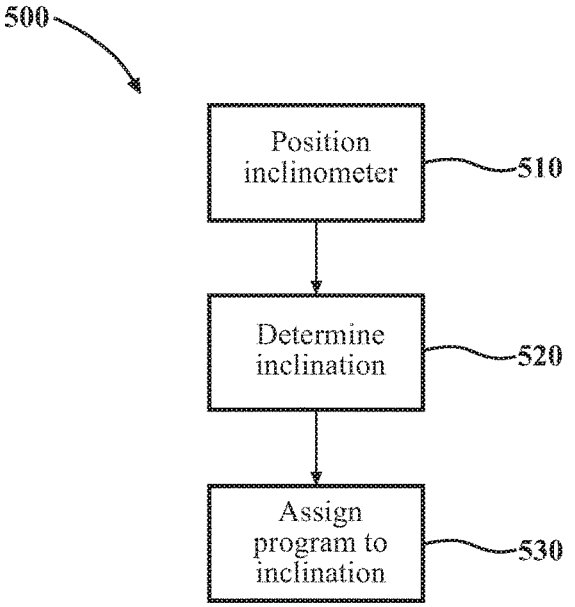
FIG. 5 is a flow diagram of an embodiment of a method for programming an inclinometer.

FIG. 5 is a flow diagram of an embodiment of a method 500 for programing an inclinometer, e.g., inclinometer 140. The method 500 begins at block 510 when the inclinometer may be positioned at an inclination where a fastener would be tightened. At step 520 the inclination may be determined by the inclinometer and associated with an output. The association may occur by toggling a switch on a programming device, e.g. programming device 220, or some other method of identifying to the inclinometer that an indicator should be output whenever the inclinometer is at the current inclination. At block 530, a program may be associated with the assigned indicator. The association of the program and the indicator may occur in a controller, e.g., controller 120. The steps of FIG. 5 may be repeated for each inclination a tool may be used in or for each of a number of indicators that the inclinometer supports. In an embodiment, the inclinometer may support two indications, thus the inclinometer may be programmed at two different inclinations to provide an indication at either of the inclinations. In other embodiments, the inclinometer may support more or less indications, and the inclinometer may be programmed at different inclinations for each of the indications supported by the inclinometer.

Figure 6:
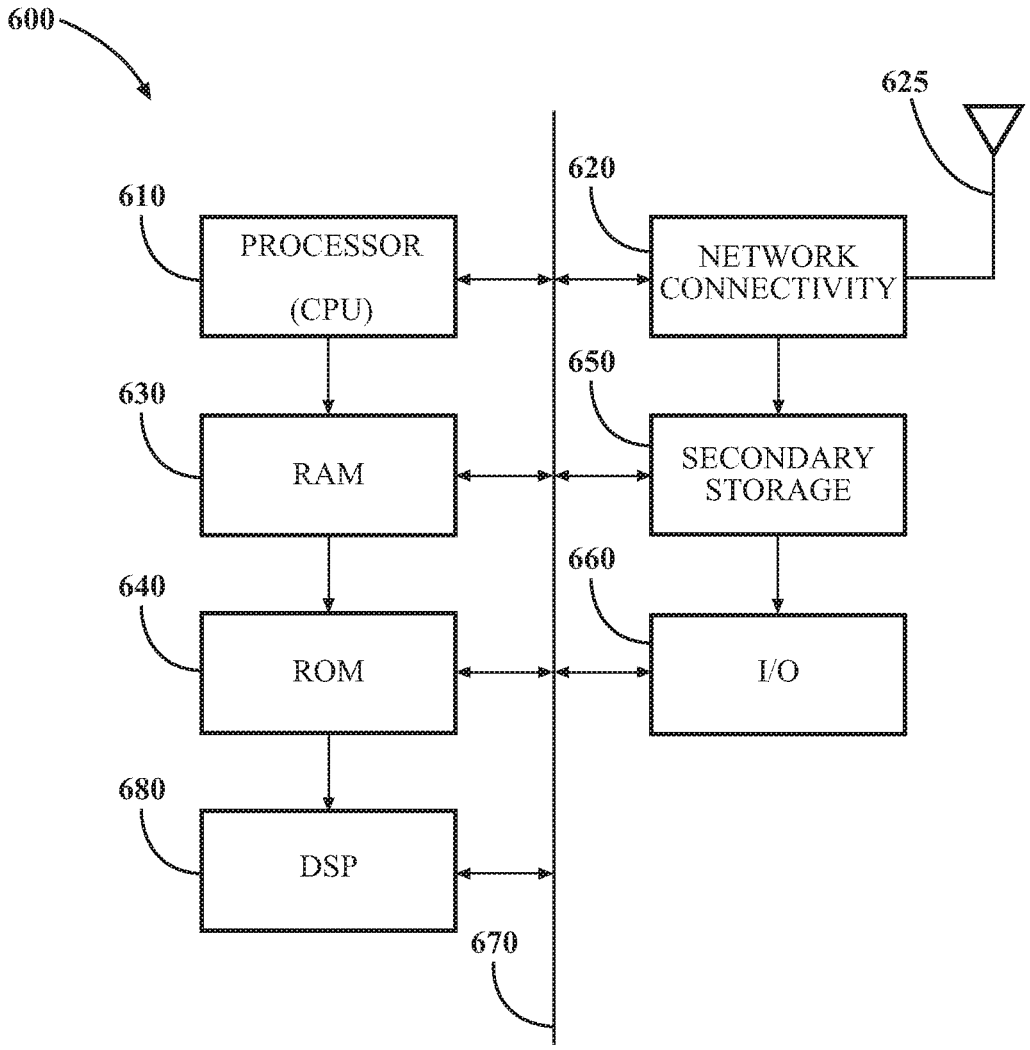
FIG. 6 is a diagram of a device for inclination based nutrunnner program selection.

FIG. 6 illustrates an example of a system 600 that includes a processor 610 suitable for implementing one or more embodiments disclosed herein. The processor 610 may control the overall operation of the device. In addition to the processor 610 (which may be referred to as a central processor unit or CPU), the system 600 might include network connectivity devices 620, random access memory (RAM) 630, read only memory (ROM) 640, secondary storage 650, and input/output (I/O) devices 660. These components might communicate with one another via a bus 670. In some cases, some of these components may not be present or may be combined in various combinations with one another or with other components not shown. These components might be located in a single physical entity or in more than one physical entity. Any actions described herein as being taken by the processor 610 might be taken by the processor 610 alone or by the processor 610 in conjunction with one or more components shown or not shown in the drawing, such as a digital signal processor (DSP) 680. Although the DSP 680 is shown as a separate component, the DSP 680 might be incorporated into the processor 610.

The processor 610 executes instructions, codes, computer programs, or scripts that it might access from the network connectivity devices 620, RAM 630, ROM 640, or secondary storage 650 (which might include various disk-based systems such as hard disk, floppy disk, or optical disk). While only one CPU 610 is shown, multiple processors may be present. Thus, while instructions may be discussed as being executed by a processor, the instructions may be executed simultaneously, serially, or otherwise by one or multiple processors. The processor 610 may be implemented as one or more CPU chips and may be a hardware device capable of executing computer instructions.

The network connectivity devices 620 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, universal mobile telecommunications system (UMTS) radio transceiver devices, long term evolution (LTE) radio transceiver devices, worldwide interoperability for microwave access (WiMAX) devices, and/or other well-known devices for connecting to networks. These network connectivity devices 620 may enable the processor 610 to communicate with the Internet or one or more telecommunications networks or other networks from which the processor 610 might receive information or to which the processor 610 might output information. The network connectivity devices 620 might also include one or more transceiver components 625 capable of transmitting and/or receiving data wirelessly.

The RAM 630 might be used to store volatile data and perhaps to store instructions that are executed by the processor 610. The ROM 640 is a non-volatile memory device that typically has a smaller memory capacity than the memory capacity of the secondary storage 650. ROM 640 might be used to store instructions and perhaps data that are read during execution of the instructions. Access to both RAM 630 and ROM 640 is typically faster than to secondary storage 650. The secondary storage 650 is typically comprised of one or more disk drives or tape drives and might be used for non-volatile storage of data or as an over-flow data storage device if RAM 630 is not large enough to hold all working data. Secondary storage 650 may be used to store programs that are loaded into RAM 630 when such programs are selected for execution The I/O devices 660 may include liquid crystal displays (LCDs), touch screen displays, keyboards, keypads, switches, dials, mice, track balls, voice recognizers, card readers, paper tape readers, printers, video monitors, or other well-known input/output devices. Also, the transceiver 625 might be considered to be a component of the I/O devices 660 instead of or in addition to being a component of the network connectivity devices 620.

Detailed embodiments are disclosed herein; however, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-6, but the embodiments are not limited to the illustrated structure or application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details.

The flowcharts and block diagrams in the figures illustrate the architecture, functionality, and operation of possible implementations of systems, methods and computer program products according to various embodiments. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The systems, components and/or processes described above can be realized in hardware or a combination of hardware and software and can be realized in a centralized fashion in one processing system or in a distributed fashion where different elements are spread across several interconnected processing systems. Any kind of processing system or other apparatus adapted for carrying out the methods described herein is suited. A typical combination of hardware and software can be a processing system with computer-usable program code that, when being loaded and executed, controls the processing system such that it carries out the methods described herein. The systems, components and/or processes also can be embedded in a computer-readable storage, such as a computer program product or other data programs storage device, readable by a machine, tangibly embodying a program of instructions executable by the machine to perform methods and processes described herein. These elements also can be embedded in an application product which comprises all the features enabling the implementation of the methods described herein and, which when loaded in a processing system, is able to carry out these methods.

Furthermore, arrangements described herein may take the form of a computer program product embodied in one or more computer-readable media having computer-readable program code embodied or embedded, e.g., stored, thereon. Any combination of one or more computer-readable media may be utilized. The computer-readable medium may be a computer-readable signal medium or a computer-readable storage medium. The phrase "computer-readable storage medium" means a non-transitory storage medium.

What is claimed is:

1. A tool comprising:

an inclinometer including a training device configured to generate a signal responsive to the tool being positioned at a first inclination, the signal being configured to associate the first inclination with a first indicator, the first indicator being configured to indicate that the inclinometer is at the first inclination, the training device also being configured to generate another signal responsive to the tool being positioned at a second inclination, the other signal being configured to associate the second inclination with a second indicator, the second indicator being configured to indicate that the inclinometer is at the second inclination, the inclinometer being configured to:

determine a current inclination of the tool;

determine if the current inclination of the tool is one of the first inclination and the second inclination;

if the current inclination is the first inclination, transmit the first indicator to a controller;

if the current inclination is the second inclination, transmit the second indicator to the controller;

a controller interface configured to receive from the controller a first program associated with the first inclination, in response to transmitting the first indicator, and also configured to receive from the controller a second program associated with the second inclination, in response to transmitting the second indicator; and a tool head configured to tighten a first fastener based, at least in part, on the first program, and also configured to tighten a second fastener based, at least in part, on the second program.

2. The tool of claim 1, wherein the tool is a nutrunner.

3. The method of claim 1, wherein the first inclination is part of a first range of inclinations.

4. The system of claim 1, wherein the second inclination is part of a second range of inclinations.

5. A method for inclination based program selection in a tool, the method comprising:

receiving, by an inclinometer, a signal from a training device responsive to the tool being positioned at a first inclination, the signal being configured to associate the first inclination with a first indicator based, at least in part, upon receiving the signal, the first indicator being configured to indicate that the inclinometer is at the first inclination;

receiving, by the inclinometer, another signal from the training device responsive to the tool being positioned at a second inclination, the other signal being configured to associate the second inclination with a second indicator based, at least in part, upon receiving the other signal, the second indicator being configured to indicate that the inclinometer is at the second inclination:

determining, by the inclinometer after association of the first inclination with the first indicator and after association of the second inclination with the second indicator, a current inclination of the tool;

determining, by the inclinometer, if the current inclination of the tool is one of the first inclination of the tool and the second inclination of the tool;

responsive to a determination that the current inclination is the first inclination:

transmitting, by the inclinometer, the first indicator to a controller;

receiving, by the tool, a first program from the controller in response to transmitting the first indicator; and tightening, by the tool, a first fastener based, at least in part, on the first program;

responsive to a determination that the current inclination is the second inclination:

transmitting, by the inclinometer, the second indicator to the controller;

receiving, by the tool, a second program from the controller in response to transmitting the second indicator; and tightening, by the tool, a second fastener based, at least in part, on the second program.

6. The method of claim 5, wherein the tool is a nutrunner.

7. The method of claim 5, wherein the second inclination is part of a second range of inclinations.

8. The method of claim 5, wherein the first inclination is part of a first range of inclinations.

9. A system for inclination based program selection, the system comprising:

a training device;

a tool comprising an inclinometer including a training interface configured to receive a signal from the training device responsive to the tool being positioned at a first inclination, the signal being configured to associate the first inclination with a first indicator based, at least in part, upon receiving the signal, the first indicator being configured to indicate that the inclinometer is at the first inclination, the training interface also being configured to receive another signal from the training device responsive to the tool being positioned at a second inclination, the other signal being configured to associate the second inclination with a second indicator based, at least in part, upon receiving the other signal, the second indicator being configured to indicate that the inclinometer is at the second inclination, the inclinometer being configured to:

determine a current inclination of the tool;

determine if the current inclination is one of the first inclination and the second inclination;

if the current inclination is the first inclination, transmit to a controller the first indicator;

if the current inclination is the second inclination, transmit to the controller the second indicator;

a controller interface configured to receive a first program from the controller in response to transmitting the first indicator, and also configured to receive a second program from the controller in response to transmitting the second indicator; and a tool head configured to tighten a first fastener based, at least in part, on the first program, and also configured to tighten a second fastener based, at least in part, on the second program; and the controller configured to:

receive the first indicator;

determine the first program based, at least in part on the first indicator; and transmit the first program to the tool, the controller also being configured to:

receive the second indicator;

determine the second program based, at least in part on the second indicator; and transmit the second program to the tool.

10. The system of claim 9 further wherein the training device comprises a switch, the training device configured to output the signal in response to toggling the switch to a first position, the training device also being configured to output the other signal in response to toggling the switch to a second position.

11. The system of claim 9, wherein the tool is a nutrunner.

12. The system of claim 9, wherein the second inclination is part of a second range of inclinations.

13. The system of claim 9, wherein the controller is further configured to:

receive a second indication from the inclinometer;

determine whether the first fastener has been tightened;

in response to determining the first fastener has been tightened, transmit a second program to the tool; and in response to determining the first fastener has not been tightened, delay transmitting the second program to the tool.

14. The system of claim 9, wherein the first inclination is part of a first range of inclinations.

* * * * *